US009425498B2

(12) United States Patent
Lee et al.

(10) Patent No.: US 9,425,498 B2
(45) Date of Patent: Aug. 23, 2016

(54) WIDEBAND ANTENNA MODULE

(71) Applicant: QUANTA COMPUTER INC., Tao Yuan Hsien (TW)

(72) Inventors: Chi-Hsuan Lee, Tao Yuan Hsien (TW); Pei-Ling Teng, Tao Yuan Hsien (TW); Kuo-Cheng Chen, Tao Yuan Hsien (TW)

(73) Assignee: QUANTA COMPUTER INC., Tao Yuan Hsien (TW)

( * ) Notice: Subject to any disclaimer, the term of this patent is extended or adjusted under 35 U.S.C. 154(b) by 36 days.

(21) Appl. No.: 14/570,326

(22) Filed: Dec. 15, 2014

(65) Prior Publication Data

US 2015/0295312 A1 Oct. 15, 2015

(30) Foreign Application Priority Data

Apr. 11, 2014 (TW) ..... 103113461 A

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 21/28*** | (2006.01) |

(52) U.S. Cl.

CPC ..... *H01Q 1/243* (2013.01); *H01Q 1/521* (2013.01); *H01Q 9/42* (2013.01); *H01Q 21/28* (2013.01)

(58) Field of Classification Search

CPC ..... H01Q 1/243; H01Q 21/28; H01Q 9/42; H01Q 1/521

USPC ..... 343/841, 845, 702

See application file for complete search history.

(56) References Cited

U.S. PATENT DOCUMENTS

| | | | | |
|---|---|---|---|---|
| 6,624,790 | B1 | 9/2003 | Wong et al. | |
| 2009/0322639 | A1* | 12/2009 | Lai | H01Q 1/243 343/770 |
| 2011/0128206 | A1* | 6/2011 | Wakabayashi | H01Q 7/005 343/860 |
| 2013/0057446 | A1* | 3/2013 | Hirobe | H01Q 1/243 343/851 |
| 2015/0061962 | A1* | 3/2015 | Lee | H01Q 9/42 343/893 |

* cited by examiner

*Primary Examiner* — Dieu H Duong
(74) *Attorney, Agent, or Firm* — Nixon & Vanderhye P.C.

(57) ABSTRACT

A wideband antenna module includes a ground conductor, two radiating conductors and a decoupling inductor. Each of the radiating conductors includes a feed-in portion, a ground portion and three radiating portions. The feed-in portion is spaced apart from the ground conductor and has a feed-in end part. The ground portion is connected to the feed-in portion and the ground conductor. For each of the radiating conductors, the radiating portions are arranged in sequence from the feed-in portion to a free end part. The decoupling inductor is connected between the free end parts of the two radiating conductors.

16 Claims, 6 Drawing Sheets

WIDEBAND ANTENNA MODULE

CROSS-REFERENCE TO RELATED APPLICATION

This application claims priority of Taiwanese Application No. 103113461, filed on Apr. 11, 2014.

BACKGROUND OF THE INVENTION

1. Field of the Invention

The present invention relates to a wideband antenna module, more particularly to a wideband antenna module having a relatively small size and good isolation.

2. Description of the Related Art

Multiple-antenna systems (e.g., multiple-input and multiple-output systems, MIMO systems) are generally used to improve data rate, data throughput, spectrum efficiency, link reliability and channel capacity. However, since portable electronic devices are becoming increasingly smaller, distances among multiple antennas in the same portable electronic device are getting shorter. When two antennas are close to each other and operate at the same resonant frequency band, mutual coupling effect between the antennas will result in poor isolation therebetween, which degrades performances of the antennas.

A conventional antenna module as disclosed in U.S. Pat. No. 6,624,790 includes a protruded ground plane disposed between two antennas for improving isolation therebetween. Nevertheless, to add the protruded ground plane between two antennas may increase the size of the conventional antenna module. Moreover, a resonant frequency band at 5 GHz of the conventional antenna module is insufficient for covering WLAN 802.11a.n.

SUMMARY OF THE INVENTION

Therefore, an object of the present invention is to provide a wideband antenna module that has a relatively small size and good isolation.

Accordingly, a wideband antenna module of the present invention includes a ground conductor, a first radiating conductor, a second radiating conductor and a decoupling inductor.

The ground conductor has a first ground end part and a second ground end part.

The first radiating conductor includes a first feed-in portion, a first ground portion, a first radiating portion, a second radiating portion and a third radiating portion.

The first feed-in portion is spaced apart from the ground conductor, and has a first feed-in end part that is configured to be fed with a first radio frequency signal and that is adjacent to the first ground end part of the ground conductor. The first ground portion is connected to the first feed-in portion and the ground conductor. The first radiating portion is connected to the first feed-in portion. The second radiating portion is connected to the first radiating portion. The third radiating portion has a first connecting end part that is connected to the first radiating portion, and a first free end part that is opposite to the first connecting end part.

The second radiating conductor includes a second feed-in portion, a second ground portion, a fourth radiating portion, a fifth radiating portion and a sixth radiating portion.

The second feed-in portion is spaced apart from the ground conductor, and has a second feed-in end part that is configured to be fed with a second radio frequency signal and that is adjacent to the second ground end part of the ground conductor. The second ground portion is connected to the second feed-in portion and the ground conductor. The fourth radiating portion is connected to the second feed-in portion. The fifth radiating portion is connected to the fourth radiating portion. The sixth radiating portion has a second connecting end part that is connected to the fourth radiating portion, and a second free end part that is opposite to the second connecting end part and that is adjacent to the first free end part of the third radiating portion of the first radiating conductor.

The decoupling inductor is connected between the first free end part of the third radiating portion and the second free end part of the sixth radiating portion.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
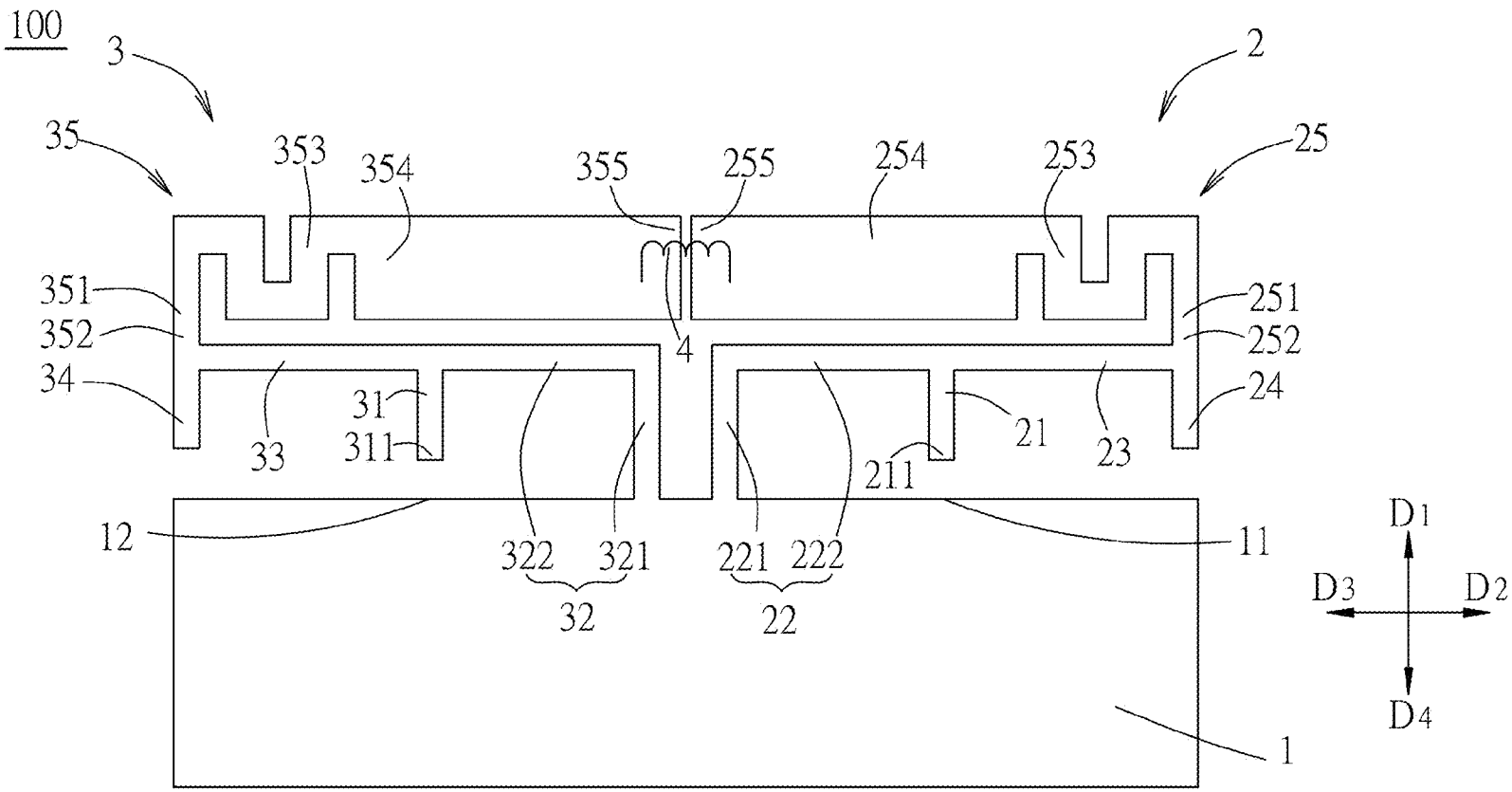
FIG. 1 is a schematic view of an embodiment of a wideband antenna module according to the present invention.

Referring to FIG. 1, an embodiment of a wideband antenna module 100 according to the present invention is shown to include a ground conductor 1, a first radiating conductor 2, a second radiating conductor 3 and a decoupling inductor 4.

The ground conductor 1 has a first ground end part 11 and a second ground end part 12.

The first radiating conductor 2 includes a first feed-in portion 21, a first ground portion 22, a first radiating portion 23, a second radiating portion 24 and a third radiating portion 25.

The first feed-in portion 21 is spaced apart from the ground conductor 1, and has a first feed-in end part 211 that is configured to be fed with a first radio frequency signal and that is adjacent to the first ground end part 11 of the ground conductor 1. The first feed-in portion 21 in this embodiment extends from the first feed-in end part 211 along a first direction ($D_1$).

The first ground portion 22 is connected to the first feed-in portion 21 and the ground conductor 1. The first ground portion 22 has a first ground segment 221 and a second ground segment 222. The first ground segment 221 extends from the ground conductor 1 along the first direction ($D_1$). The second ground segment 222 extends, from an end of the first ground segment 221 away from the ground conductor 1, to the first feed-in portion 21 along a second direction ($D_2$). In this embodiment, the second direction ($D_2$) is transverse to the first direction ($D_1$).

The first radiating portion 23 is connected to the first feed-in portion 21. Specifically, the first radiating portion 23 extends, from an end of the first feed-in portion 21 away from the ground conductor 1, along the second direction ($D_2$).

The second radiating portion 24 is connected to the first radiating portion 23. Specifically, the second radiating portion 24 extends, from an end of the first radiating portion 23 away from the first feed-in portion 21, along a fourth direction ($D_4$). The fourth direction ($D_4$) is opposite to the first direction ($D_1$).

The third radiating portion 25 has a first connecting end part 252 that is connected to the first radiating portion 23, and a first free end part 255 that is opposite to the first connecting end part 252. In this embodiment, the third radiating portion 25 has a first connecting segment 251, a first meandering segment 253 and a first extension segment 254. The first connecting segment 251 has the first connecting end part 252 and extends, from an end of the first radiating portion 23 away from the first feed-in portion 21, along the first direction ($D_1$). The first meandering segment 253 extends, from an end of the first connecting segment 251 away from the first radiating portion 23, along a third direction ($D_3$). The third direction ($D_3$) is opposite to the second direction ($D_2$). The first extension segment 254 has the first free end part 255 and extends, from an end of the first meandering segment 253 away from the first connecting segment 251, along the third direction ($D_3$).

The second radiating conductor 3 includes a second feed-in portion 31, a second ground portion 32, a fourth radiating portion 33, a fifth radiating portion 34 and a sixth radiating portion 35.

The second feed-in portion 31 is spaced apart from the ground conductor 1, and has a second feed-in end part 311 that is configured to be fed with a second radio frequency signal and that is adjacent to the second ground end part 12 of the ground conductor 1. The second feed-in portion 31 in this embodiment extends from the second feed-in end part 311 along the first direction ($D_1$).

The second ground portion 32 is connected to the second feed-in portion 31 and the ground conductor 1. The second ground portion 32 has a third ground segment 321 and a fourth ground segment 322. The third ground segment 321 extends from the ground conductor 1 along the first direction ($D_1$). The fourth ground segment 322 extends, from an end of the third ground segment 321 away from the ground conductor 1, to the second feed-in portion 31 along the third direction ($D_3$).

The fourth radiating portion 33 is connected to the second feed-in portion 31. Specifically, the fourth radiating portion 33 extends, from an end of the second feed-in portion 31 away from the ground conductor 1, along the third direction ($D_2$).

The fifth radiating portion 34 is connected to the fourth radiating portion 33. Specifically, the fifth radiating portion 34 extends, from an end of the fourth radiating portion 33 away from the second feed-in portion 31, along the fourth direction ($D_4$).

The sixth radiating portion 35 has a second connecting end part 352 that is connected to the fourth radiating portion 33, and a second free end part 355 that is opposite to the second connecting end part 352 and that is adjacent to the first free end part 255 of the third radiating portion 25. In this embodiment, the sixth radiating portion 35 has a second connecting segment 351, a second meandering segment 353 and a second extension segment 354. The second connecting segment 351 has the second connecting end part 352 and extends, from an end of the fourth radiating portion 33 away from the second feed-in portion 31, along the first direction ($D_1$). The second meandering segment 353 extends, from an end of the second connecting segment 351 away from the fourth radiating portion 33, along the second direction ($D_2$). The second extension segment 354 has the second free end part 355 and extends, from an end of the second meandering segment 353 away from the second connecting segment 351, along the second direction ($D_2$).

The decoupling inductor 4 is connected between the first free end part 255 of the third radiating portion 25 and the second free end part 355 of the sixth radiating portion 35.

In addition, the first ground end part 11 and the second ground end part 12 of this embodiment are connected electrically to two outer conductors of two respective coaxial cables (not shown) for receiving grounding signals, respectively. The first feed-in end part 211 and the second feed-in end part 311 of this embodiment are connected electrically to inner conductors of the coaxial cables for receiving the first radio frequency signal and the second radio frequency signal, respectively. Moreover, the first radiating conductor 2 of this embodiment cooperates with the ground conductor 1 to form an inverted-F antenna, and the second radiating conductor 3 of this embodiment cooperates with the ground conductor 1 to form another inverted-F antenna.

Figure 2:
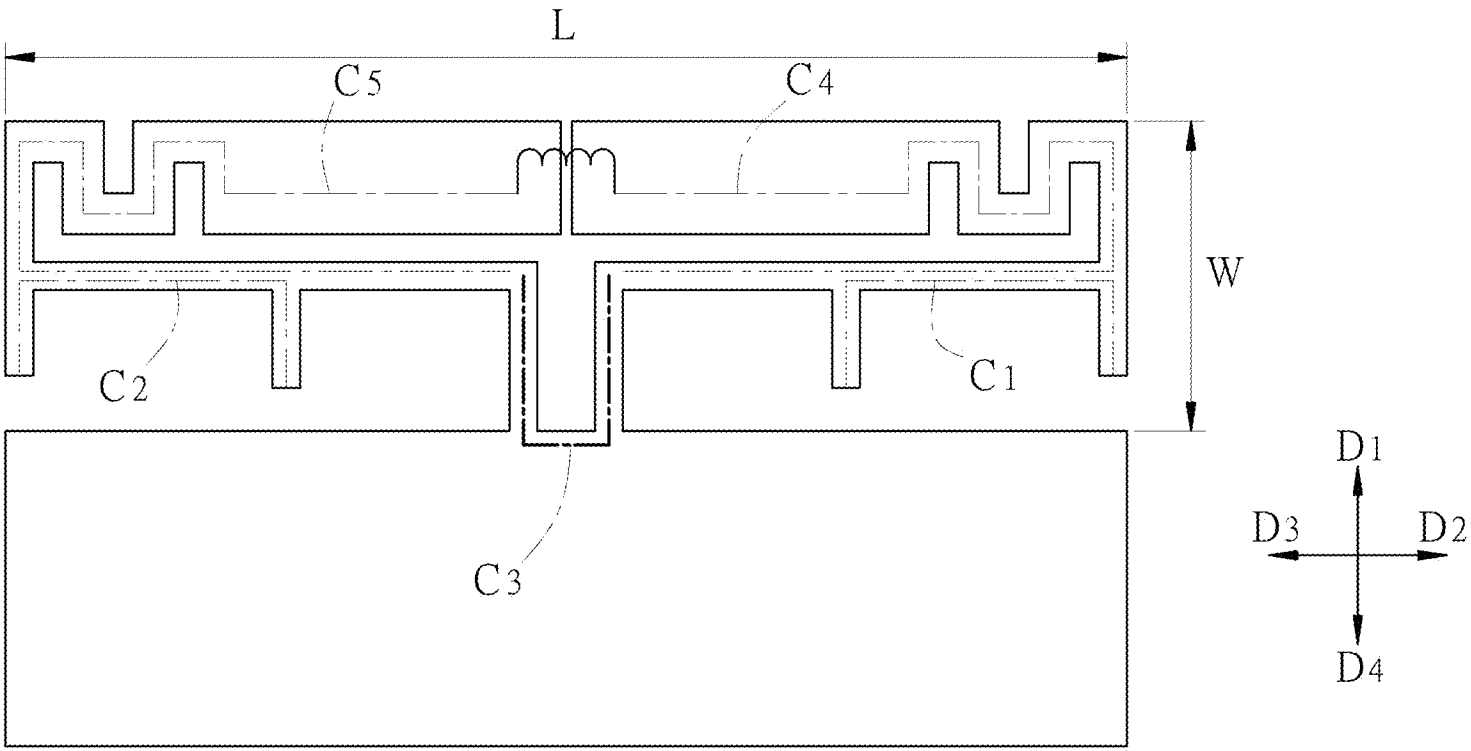
FIG. 2 is a schematic view similar to FIG. 1 for illustrating a current path and a size of the wideband antenna module.
Figure 3:
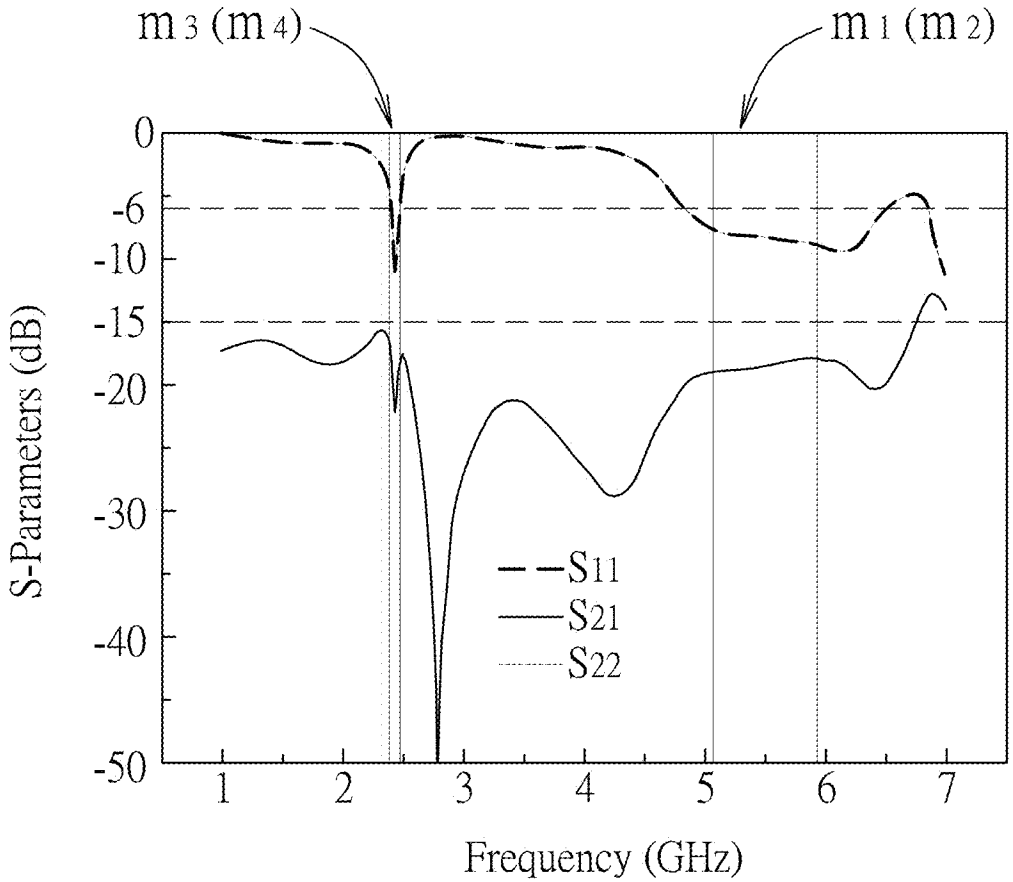
FIG. 3 is a plot showing S-parameters of the wideband antenna module according to the present invention.

Referring further to FIGS. 2 and 3, the first feed-in portion 21, the first radiating portion 23 and the second radiating portion 24 cooperate to forma first current path ($C_1$) for operating in a first resonant mode ($m_1$). The first resonant mode ($m_1$) covers a first frequency band. The second feed-in portion 31, the fourth radiating portion 33 and the fifth radiating portion 34 cooperate to form a second current path ($C_2$) for operating in a second resonant mode ($m_2$). The second resonant mode ($m_2$) covers the first frequency band. The first ground segment 221 of the first ground portion 22, the ground conductor 1 and the third ground segment 321 of the second ground portion 32 cooperate to form a third current path ($C_3$). A length of the third current path ($C_3$) is one-half of a wavelength corresponding to the first frequency band.

The second ground segment 222 of the first ground portion 22, the first radiating portion 23 and the third radiating portion 25 cooperate to form a fourth current path ($C_4$) for operating in a third resonant mode ($m_3$). The third resonant mode ($m_3$) covers a second frequency band that has a frequency lower than the first frequency band. The fourth ground segment 322 of the second ground portion 32, the fourth radiating portion 33 and the sixth radiating portion 35 cooperate to form a fifth current path ($C_5$) for operating in a fourth resonant mode ($m_4$) that covers the second frequency band.

Since the first resonant mode ($m_1$) and the second resonant mode ($m_2$) cover the first frequency band, and the third resonant mode ($m_3$) and the fourth resonant mode ($m_4$) cover the second frequency band, the effect of wideband transmission may be achieved by the wideband antenna module 100. Particularly, in this embodiment, the first frequency band ranges between 5 GHz~6 GHz, and the second frequency band ranges between 2.4 GHz~2.5 GHz. That is to say, the first and second frequency bands of the wideband antenna module 100 may cover WLAN (Wireless Local Area Networks) 802.11a.b.g.n and ac. Moreover, since the length of the third current path ($C_3$) is one-half of the wavelength corresponding to the first frequency band, isolation when the wideband antenna module 100 operates at the first frequency band may be effectively improved. Furthermore, since the decoupling inductor 4 is connected between the first free end part 255 and the second free end part 355, a capacitive coupling effect between the first and second radiating conductors 2, 3 may be reduced, thereby effectively improving isolation when the wideband antenna module 100 operates at the second frequency band.

FIG. 3 is a plot showing S-parameters of the wideband antenna module 100 according to the present invention. A curve ($S_{11}$) shows a return loss related to the first feed-in end part 211 of the first feed-in portion 21 of the first radiating conductor 2. A curve ($S_{22}$) shows a return loss related to the second feed-in end part 311 of the second feed-in portion 31 of the second radiating conductor 3. A curve ($S_{21}$) shows isolation between the first feed-in end part 211 of the first radiating conductor 2 and the second feed-in end part 311 of the second radiating conductor 3. According to FIG. 3, the curves ($S_{11}$, $S_{22}$) indicate that the return loss of the first frequency band covered by the first and second resonant modes ($m_1$, $m_2$) is less than −6 dB, and the return loss of the second frequency band covered by the third and fourth resonant modes ($m_3$, $m_4$) is less than −6 dB. The curve ($S_{21}$) indicates that the isolation between the first and second radiating conductors 2, 3 at the first and second frequency bands is lower than −15 dB.

Figures 4, 5:
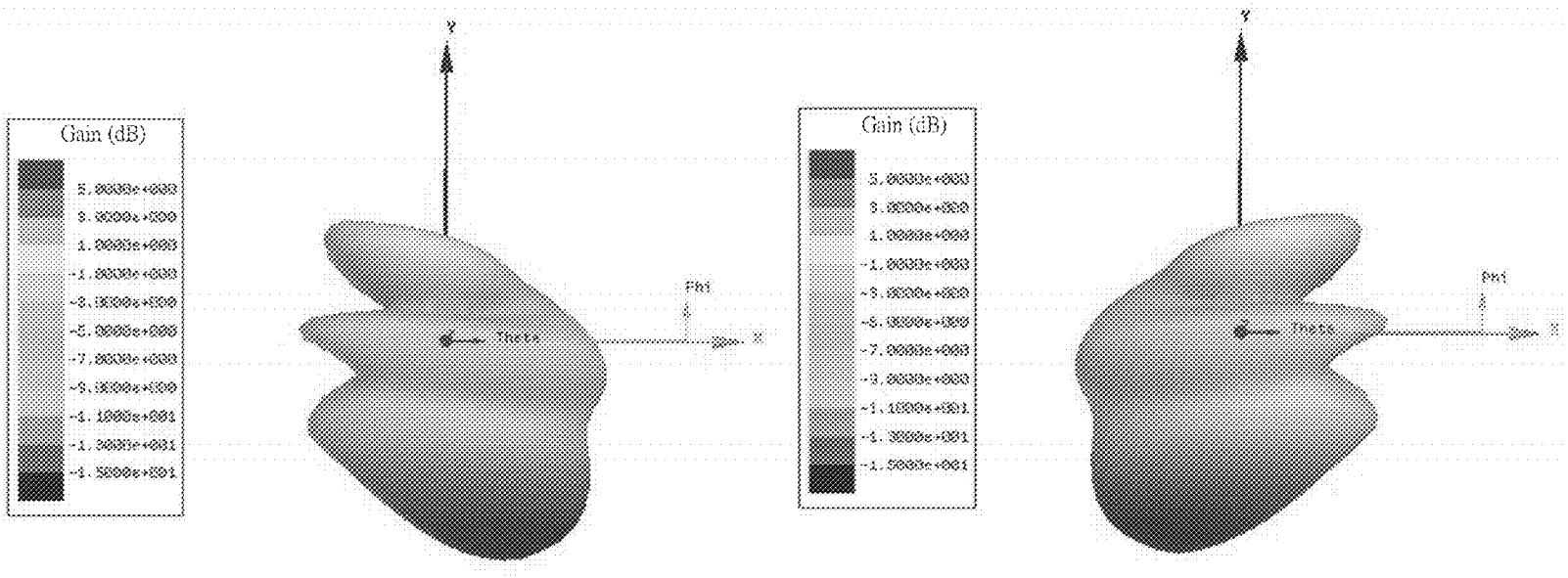
FIG. 4 is a radiation pattern of a first radiating conductor and a ground conductor of the wideband antenna module operating at a first frequency band.
FIG. 5 is a radiation pattern of a second radiating conductor and the ground conductor of the wideband antenna module operating at the first frequency band.

FIG. 4 is a radiation pattern of the first radiating conductor 2 and the ground conductor 1 of the wideband antenna module 100 operating at the first frequency band. FIG. 5 is a radiation pattern of the second radiating conductor 3 and the ground conductor 1 of the wideband antenna module 100 operating at the first frequency band. A y axis shown in FIGS. 4 and 5 extends along the first and fourth directions ($D_1$, $D_4$). An x axis shown in FIGS. 4 and 5 extends along the second and third directions ($D_2$, $D_3$). The radiation pattern shown in FIG. 4 is symmetrical with the radiation pattern shown in FIG. 5 about the y axis, which represents that correlation between the radiation patterns of the first and second radiating conductors 2, 3 operating at the first frequency band is low. Therefore, the wideband antenna module 100 of this embodiment is suitable for application to multiple-input multiple-output (MIMO) antenna systems.

Figure 6:
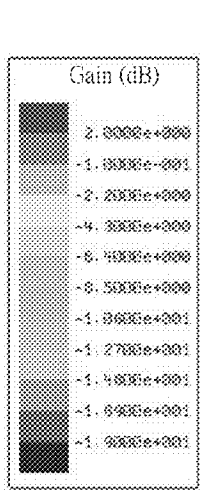
FIG. 6 is a radiation pattern of the first radiating conductor and the ground conductor of the wideband antenna module operating at a second frequency band.
Figure 7:
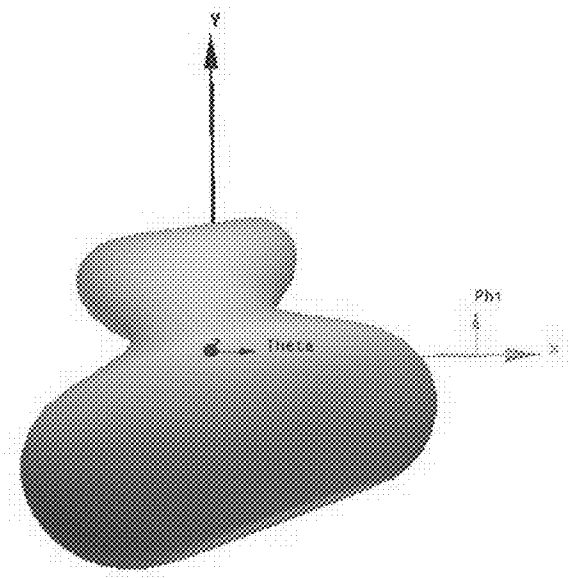
FIG. 7 is a radiation pattern of the second radiating conductor and the ground conductor of the wideband antenna module operating at the second frequency band.

FIG. 6 is a radiation pattern of the first radiating conductor 2 and the ground conductor 1 of the wideband antenna module 100 operating at the second frequency band. FIG. 7 is a radiation pattern of the second radiating conductor 3 and the ground conductor 1 of the wideband antenna module 100 operating at the second frequency band. The radiation pattern shown in FIG. 6 is symmetrical with the radiation pattern shown in FIG. 7 about the y axis, which represents that correlation between the radiation patterns of the first and second radiating conductors 2, 3 operating at the second frequency band is low. Therefore, the wideband antenna module 100 of this embodiment is suitable for application to MIMO antenna systems.

Figure 8:
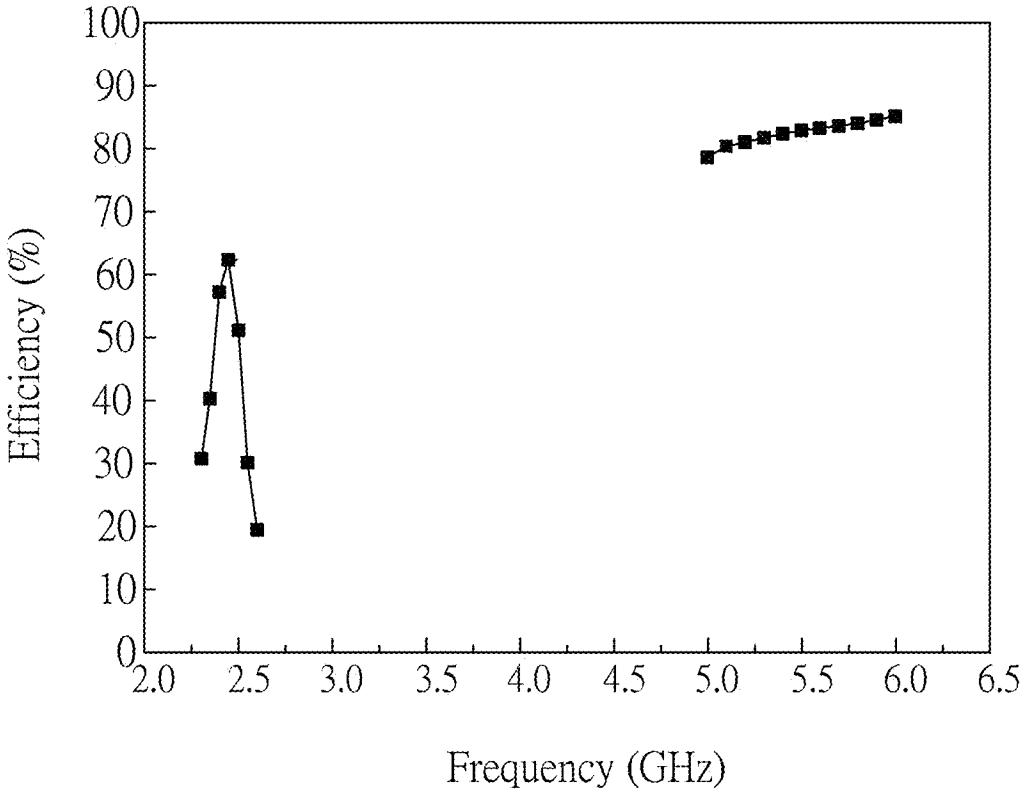
FIG. 8 is a plot showing radiating efficiency of the wideband antenna module according to the present invention.

FIG. 8 is a plot showing radiating efficiency of the wideband antenna module 100 according to the present invention. The radiating efficiency of the wideband antenna module 100 operating at the first frequency band ranges between 78%~85%. The radiating efficiency of the wideband antenna module 100 operating at the second frequency band ranges between 50%~62%. Therefore, it is evident that the radiating efficiencies of the wideband antenna module 100 operating at the first and second frequencies are good.

Referring once again to FIGS. 1 and 2, it is noted that a combination of the first and second radiating conductors 2, 3 has a length (L) and a width (W). In this embodiment, the length (L) is 23 mm and the width (W) is 12 mm. It is evident that the wideband antenna module 100 of the present invention has a relatively small size.

To conclude, by virtue of the first, second, fourth and fifth current paths ($C_1$, $C_2$, $C_4$, $C_5$) of the present invention, the wideband antenna module 100 may operate at the first and second frequency bands to thereby achieve wideband transmission. Moreover, the length of the third current path ($C_3$) is one-half of the wavelength corresponding to the first frequency band, and the decoupling inductor 4 is connected between the first free end part 255 and the second free end part 355. As a result, isolation of the wideband antenna module 100 of the present invention operating at the first and second frequency bands may be effectively improved. Furthermore, the wideband antenna module 100 of the present invention has a relatively small size.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A wideband antenna module, comprising:

a ground conductor having a first ground end part and a second ground end part;

a first radiating conductor including a first feed-in portion spaced apart from said ground conductor, and having a first feed-in end part that is configured to be fed with a first radio frequency signal and that is adjacent to said first ground end part of said ground conductor, a first ground portion connected to said first feed-in portion and said ground conductor, a first radiating portion connected to said first feed-in portion, a second radiating portion connected to said first radiating portion, and a third radiating portion having a first connecting end part that is connected to said first radiating portion, and a first free end part that is opposite to said first connecting end part;

a second radiating conductor including a second feed-in portion spaced apart from said ground conductor, and having a second feed-in end part that is configured to be fed with a second radio frequency signal and that is adjacent to said second ground end part of said ground conductor, a second ground portion connected to said second feed-in portion and said ground conductor, a fourth radiating portion connected to said second feed-in portion, a fifth radiating portion connected to said fourth radiating portion, and a sixth radiating portion having a second connecting end part that is connected to said fourth radiating portion, and a second free end part that is opposite to said second connecting end part and that is adjacent to said first free end part of said third radiating portion; and a decoupling inductor connected between said first free end part of said third radiating portion and said second free end part of said sixth radiating portion, wherein said first feed-in portion, said first radiating portion and said second radiating portion cooperate to form a first current path for operating in a first resonant mode, the first resonant mode covering a first frequency band, and said second feed-in portion, said fourth radiating portion and said fifth radiating portion cooperate to form a second current path for operating in a second resonant mode, the second resonant mode covering the first frequency band.

2. The wideband antenna module as claimed in claim 1, wherein said first ground portion of said first radiating conductor has a first ground segment that extends from said ground conductor along a first direction, and a second ground segment that extends from said first ground segment to said first feed-in portion along a second direction, and said second ground portion of said second radiating conductor has a third ground segment that extends from said ground conductor along the first direction, and a fourth ground segment that extends from said third ground segment to said second feed-in portion along a third direction.

3. The wideband antenna module as claimed in claim 2, wherein said first ground segment of said first ground portion, said ground conductor and said third ground segment of said second ground portion cooperate to form a third current path, a length of the third current path being one-half of a wavelength corresponding to the first frequency band.

4. The wideband antenna module as claimed in claim 3, wherein said second ground segment of said first ground portion, said first radiating portion and said third radiating portion cooperate to form a fourth current path for operating in a third resonant mode that covers a second frequency band, the second frequency band having a frequency lower than the first frequency band; and said fourth ground segment of said second ground portion, said fourth radiating portion and said sixth radiating portion cooperate to form a fifth current path for operating in a fourth resonant mode that covers the second frequency band.

5. The wideband antenna module as claimed in claim 4, wherein the second direction is transverse to the first direction, and the third direction is opposite to the second direction.

6. The wideband antenna module as claimed in claim 5, wherein said first radiating portion extends from said first feed-in portion along the second direction, said second radiating portion extends from said first radiating portion along a fourth direction that is opposite to the first direction, said fourth radiating portion extends from said second feed-in portion along the third direction, and said fifth radiating portion extends from said fourth radiating portion along the fourth direction.

7. The wideband antenna module as claimed in claim 6, wherein said third radiating portion has a first connecting segment that has said first connecting end part and that extends from said first radiating portion along the first direction, a first meandering segment that extends from said first connecting segment along the third direction, and a first extension segment that has said first free end part and that extends from said first meandering segment along the third direction.

8. The wideband antenna module as claimed in claim 7, wherein said sixth radiating portion has a second connecting segment that has said second connecting end part and that extends from said fourth radiating portion along the first direction, a second meandering segment that extends from said second connecting segment along the second direction, and a second extension segment that has said second free end part and that extends from said second meandering segment along the second direction.

9. The wideband antenna module as claimed in claim 8, wherein each of said first feed-in portion and said second feed-in portion extends along the first direction.

10. The wideband antenna module as claimed in claim 9, wherein the first frequency band ranges between 5 GHz~6 GHz, and the second frequency band ranges between 2.4 GHz~2.5 GHz.

11. The wideband antenna module as claimed in claim 4, wherein the first frequency band ranges between 5 GHz~6 GHz, and the second frequency band ranges between 2.4 GHz~2.5 GHz.

12. The wideband antenna module as claimed in claim 2, wherein the second direction is transverse to the first direction, and the third direction is opposite to the second direction.

13. The wideband antenna module as claimed in claim 12, wherein said first radiating portion extends from said first feed-in portion along the second direction, said second radiating portion extends from said first radiating portion along a fourth direction that is opposite to the first direction, said fourth radiating portion extends from said second feed-in portion along the third direction, and said fifth radiating portion extends from said fourth radiating portion along the fourth direction.

14. The wideband antenna module as claimed in claim 12, wherein said third radiating portion has a first connecting segment that has said first connecting end part and that extends from said first radiating portion along the first direction, a first meandering segment that extends from said first connecting segment along the third direction, and a first extension segment that has said first free end part and that extends from said first meandering segment along the third direction.

15. The wideband antenna module as claimed in claim 14, wherein said sixth radiating portion has a second connecting segment that has said second connecting end part and that extends from said fourth radiating portion along the first direction, a second meandering segment that extends from said second connecting segment along the second direction, and a second extension segment that has said second free end part and that extends from said second meandering segment along the second direction.

16. The wideband antenna module as claimed in claim 2, wherein each of said first feed-in portion and said second feed-in portion extends along the first direction.

* * * * *